US011702833B1

(12) United States Patent
Cook

(10) Patent No.: US 11,702,833 B1
(45) Date of Patent: Jul. 18, 2023

(54) DRAINAGE SYSTEMS AND METHODS

(71) Applicant: Ronny C Cook, Plain Dealing, LA (US)

(72) Inventor: Ronny C Cook, Plain Dealing, LA (US)

( * ) Notice: Subject to any disclaimer, the term of this patent is extended or adjusted under 35 U.S.C. 154(b) by 0 days.

(21) Appl. No.: 17/977,701

(22) Filed: Oct. 31, 2022

Related U.S. Application Data

(63) Continuation of application No. 17/897,320, filed on Aug. 29, 2022.

(51) Int. Cl.
*E03F 1/00* (2006.01)

(52) U.S. Cl.
CPC ..... *E03F 1/002* (2013.01); *E03F 1/001* (2013.01)

(58) Field of Classification Search
CPC ..... E03F 1/001; E03F 1/002
See application file for complete search history.

(56) References Cited

U.S. PATENT DOCUMENTS

| | | | | |
|---|---|---|---|---|
| 921,513 | A | 5/1909 | Crawford | |
| 1,083,148 | A * | 12/1913 | Sparks | E03F 1/002 405/36 |
| 2,762,202 | A | 9/1956 | Ponsar | |
| 3,803,851 | A | 4/1974 | Soileau | |
| 4,578,188 | A | 3/1986 | Cousino | |
| 5,672,028 | A | 9/1997 | Maheshkumar | |
| 10,316,505 | B2 | 6/2019 | Cole | |
| 2002/0044835 | A1 | 4/2002 | Esposito et al. | |

* cited by examiner

*Primary Examiner* — Tara Mayo
(74) *Attorney, Agent, or Firm* — R. Keith Harrison

(57) ABSTRACT

Drainage systems for draining precipitation and/or other water from an area to be drained may include a geographical area and a flowing water body As flowing water in the flowing water body adjacently traverses a conduit discharge opening of a drain conduit which communicates with the geographical area and discharges into the water body, the flowing water may induce negative fluid pressure in the drain conduit through the conduit discharge opening. The negative fluid pressure may draw drainage water from the ground at the geographical area through the drain conduit into the flowing water body.

12 Claims, 10 Drawing Sheets

DRAINAGE SYSTEMS AND METHODS

CROSS-REFERENCE TO RELATED APPLICATIONS

This application is a continuation of U.S. non-provisional application Ser. No. 17/897,320, filed Aug. 29, 2022, and entitled DRAINAGE SYSTEMS AND METHODS, which application is hereby incorporated by reference herein in its entirety.

FIELD

Illustrative embodiments of the disclosure are generally directed to systems and methods for draining precipitation and/or other water from an area to be drained. More particularly, illustrative embodiments of the disclosure relate to drainage systems and methods in which flowing water in a water body creates negative fluid pressure which draws drainage water from an area to be drained into the water body.

SUMMARY

Illustrative embodiments of the disclosure are generally directed to drainage systems for draining precipitation and/or other water from an area to be drained. An illustrative embodiment of the drainage systems may include a geographical area including a drainage area from which drainage water is to be drained and a flowing water body having flowing water flowing in a flowing water direction. A drain inlet opening may be provided in the ground at the drainage area. A drain conduit may have a longitudinal drain conduit axis disposed at an acute drain conduit angle with respect to the flowing water direction as measured on an upstream side of the drain conduit. The drain conduit may include a drain conduit inlet end having a conduit inlet opening disposed in fluid communication with the drain inlet opening. A conduit bore may be disposed in fluid communication with the conduit inlet opening. A drain conduit discharge end may have a conduit discharge opening disposed in fluid communication with the conduit bore. The conduit discharge opening may have a discharge opening plane oriented parallel to the flowing water direction of the flowing water in the flowing water body. Accordingly, as the flowing water in the flowing water body adjacently traverses the conduit discharge opening, the flowing water may induce negative fluid pressure through the conduit discharge opening, the conduit bore and the conduit inlet opening of the drain conduit and in the drain inlet opening, respectively. The negative fluid pressure may draw drainage water from the ground at the drainage area through the drain inlet opening and the conduit inlet opening, the conduit bore and the conduit discharge opening, respectively, of the drain conduit into the flowing water body.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front" "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
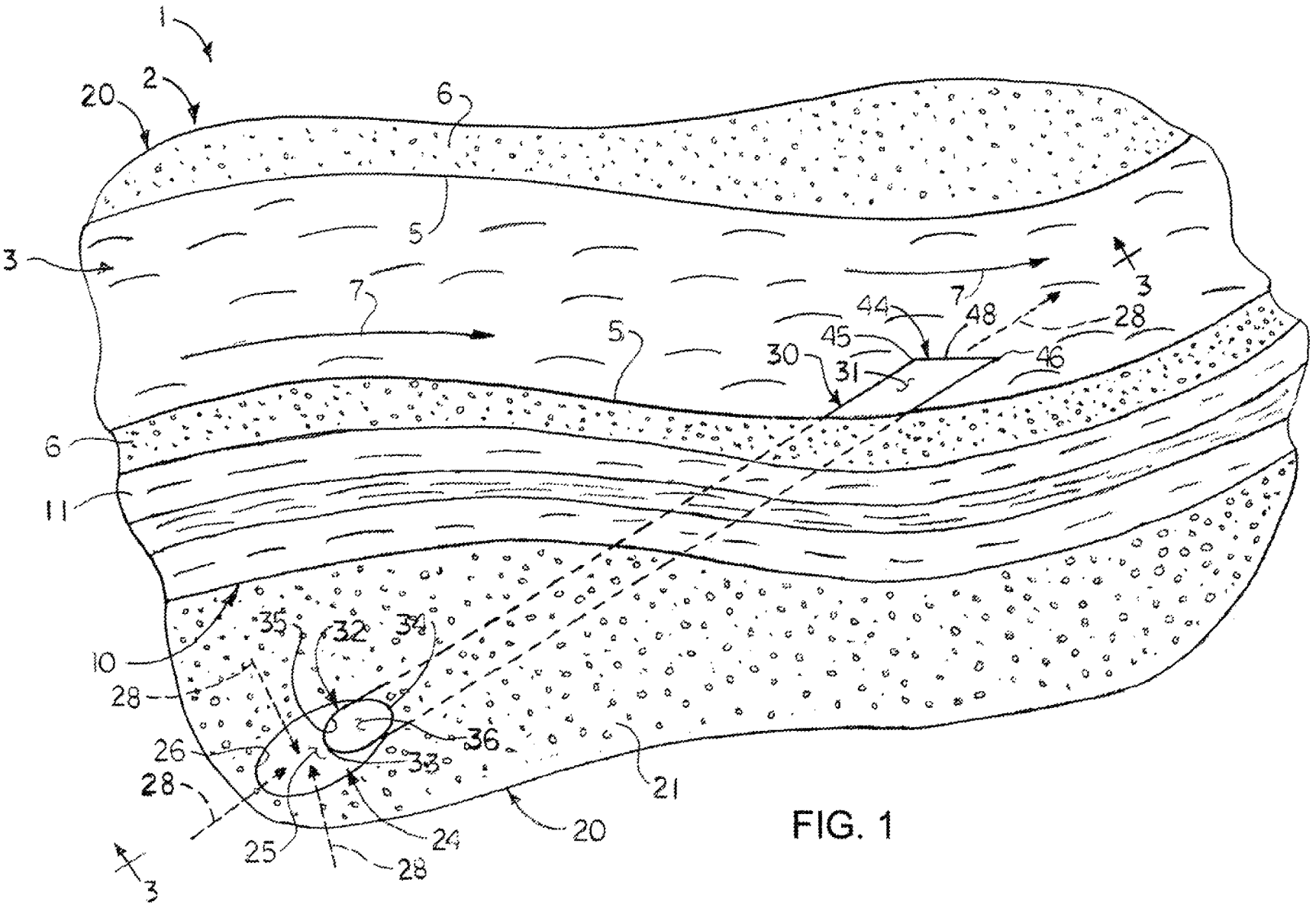
FIG. 1 is a top view of an illustrative embodiment of the drainage systems, installed in a typical geographical area and having a drain conduit extending from a drain inlet opening in the ground at a drainage area to a flowing water body for transfer of drainage water from the drainage area through the drain conduit to the water body, and additionally illustrating a structure in the form of a levee between the drain inlet opening and the water body.

Referring initially to FIGS. 1-16 of the drawings, an illustrative embodiment of a drainage system is generally indicated by reference numeral 1. As illustrated in FIG. 1, the drainage system 1 may include a geographical area 2 having a flowing water body 3 and a drainage area 20 from which drainage water 28 is to be drained into the flowing water body 3. A drain inlet opening 24 may be provided in the ground 21 at the drainage area 20. The flowing water body 3 may have flowing water 7 which flows in a generally linear flowing water direction 8 (FIG. 5). A drain conduit 30 may extend from the drainage area 20 to the flowing water body 3. The drainage system 1 may induce and utilize negative fluid pressure which draws the drainage water 28 from the drainage area 20 through the drain inlet opening 24 and the drain conduit 30, respectively, into the flowing water body 3, typically as will be hereinafter described. As used herein. "upstream" denotes an upstream position relative to the flowing water direction 8, whereas "downstream" denotes a downstream position relative to the flowing water direction 8.

Figure 2:
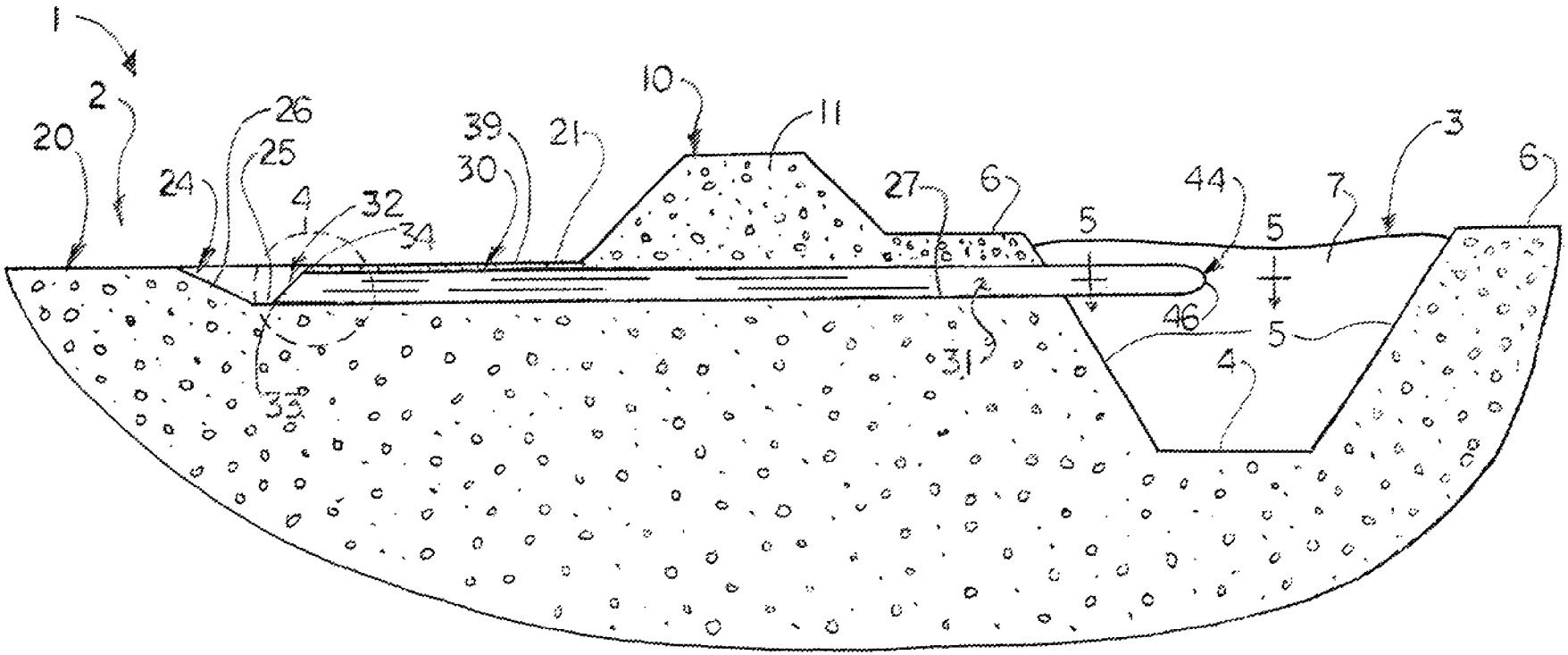
FIG. 2 is a vertical cross-sectional view of the geographical area illustrated in FIG. 1, with the drain conduit extending from the drain inlet opening to the water body.
Figure 3:
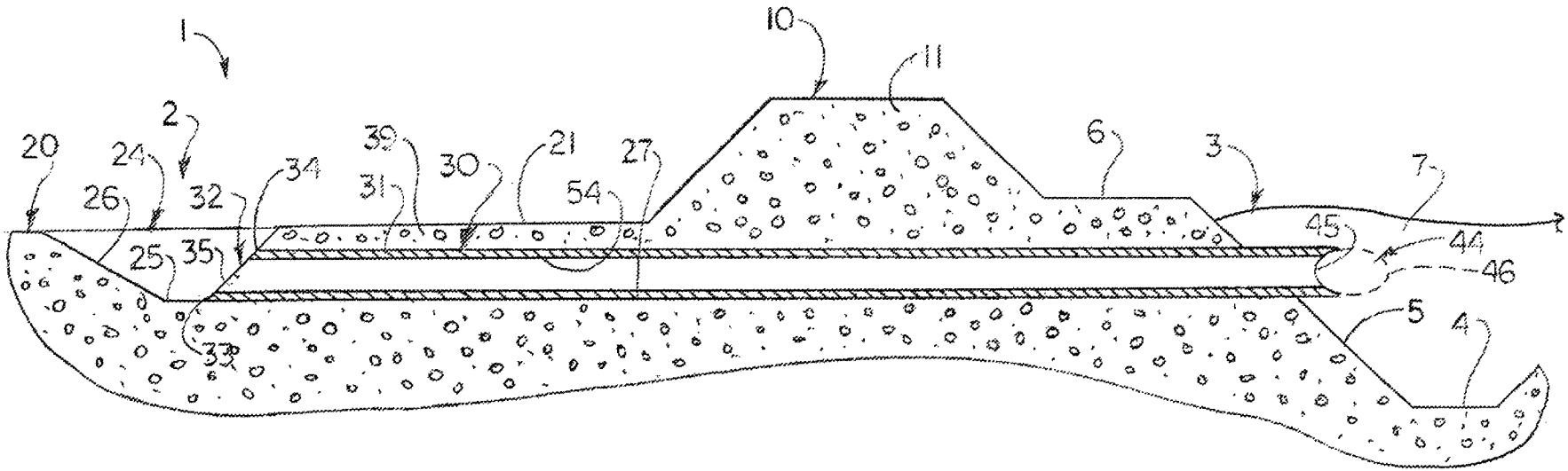
FIG. 3 is a vertical cross-sectional view, taken along section lines 3-3 in FIG. 1, of the drain conduit situated between the drain inlet opening and the water body in the geographical area.
Figure 15:
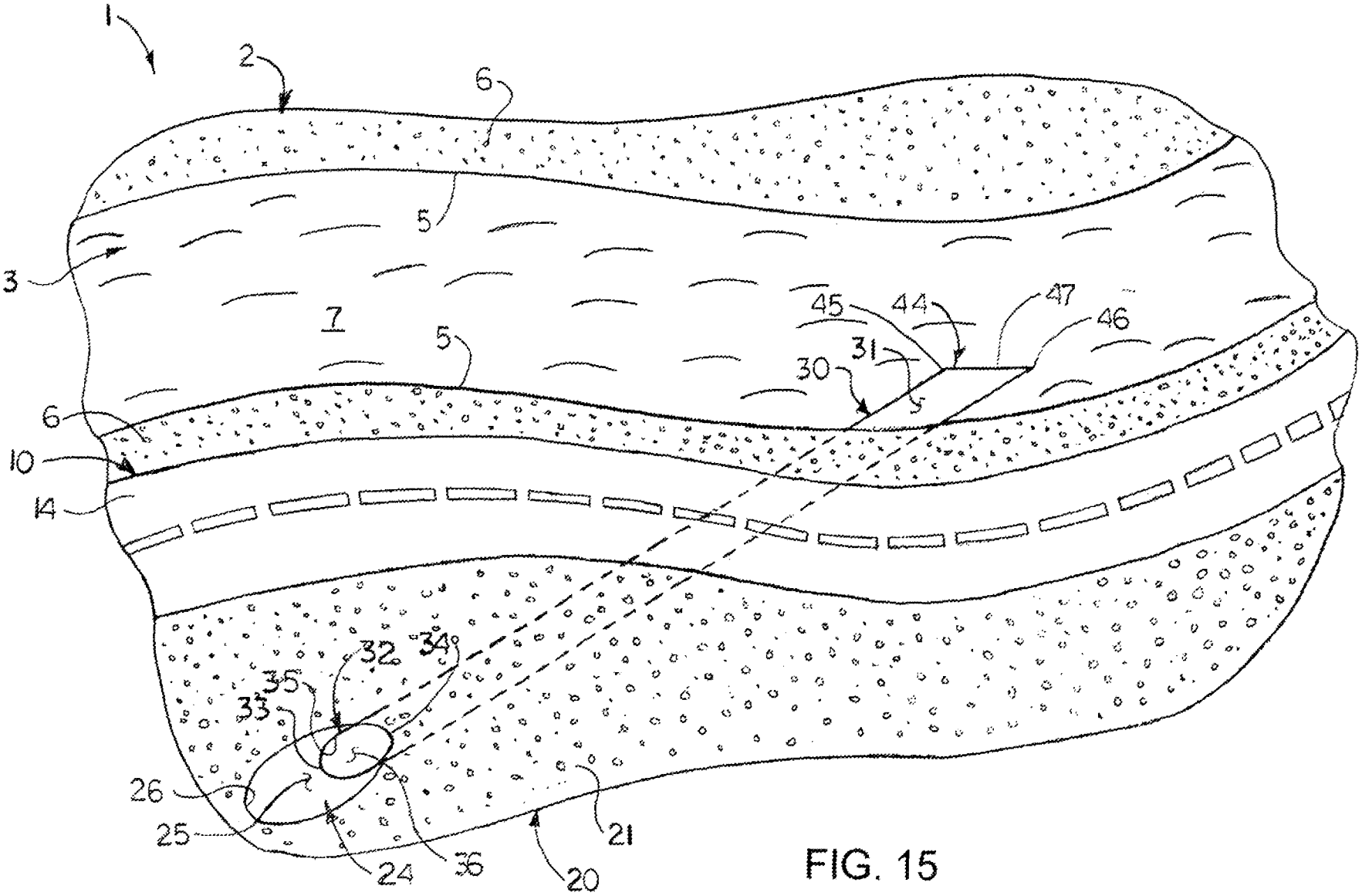
FIG. 15 is a top view of an illustrative embodiment of the drainage systems, with a structure in the form of a road between the drain inlet opening and the water body.
Figure 16:
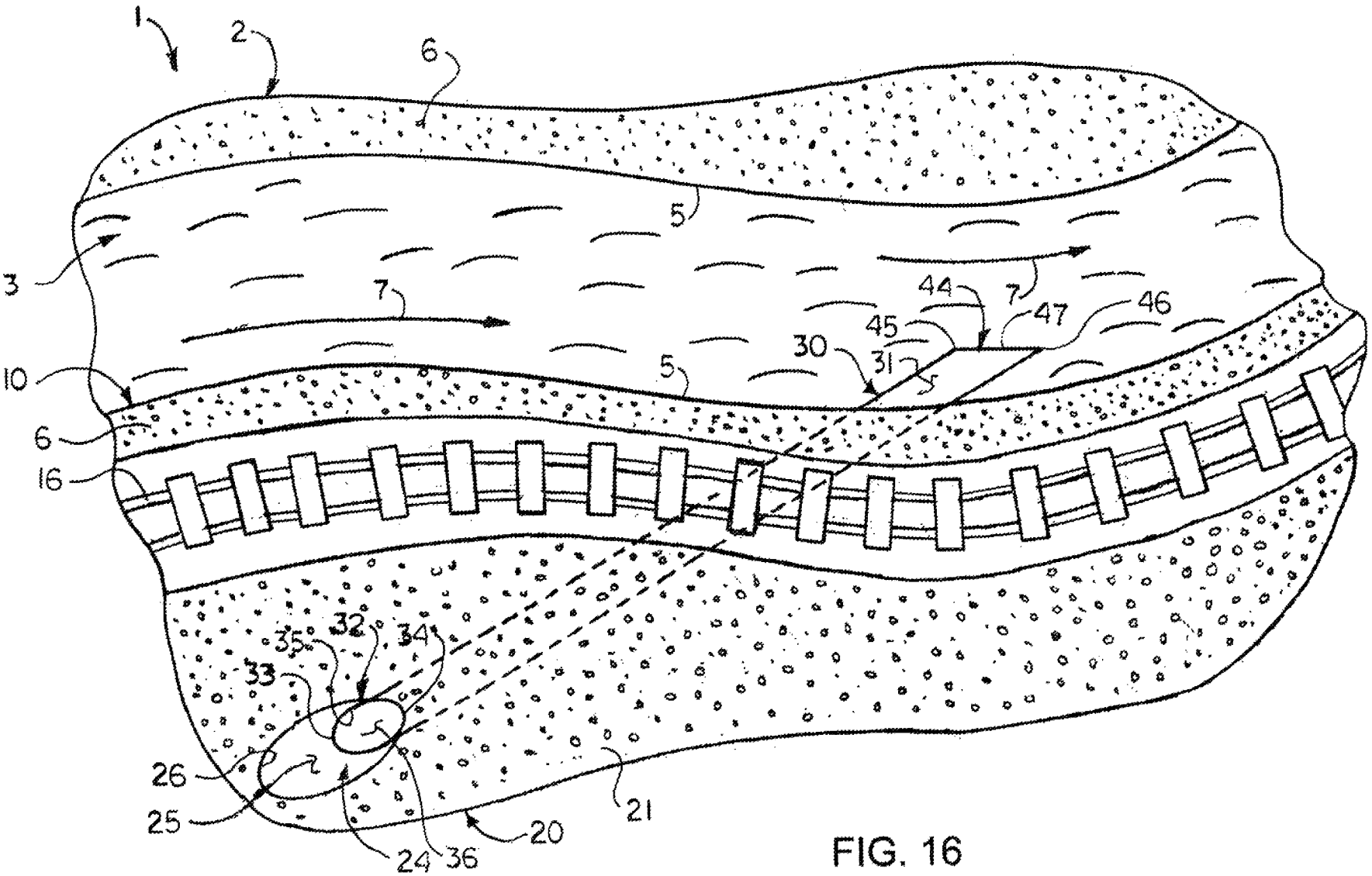
FIG. 16 is a top view of an illustrative embodiment of the drainage systems, with a structure in the form of a railroad between the drain inlet opening and the water body.

The geographical area 2 may include an urban geographical area and/or a rural geographical area. As illustrated in FIGS. 1, 15 and 16, in some embodiments, at least one natural and/or manmade structure 10 may extend between the flowing water body 3 and the drainage area 20. For example and without limitation, as illustrated in FIGS. 1-3, in some embodiments, the structure 10 may include a levee 11. Alternatively, as illustrated in FIG. 15, in some embodiments, the structure 10 may include a road 14. Still further in the alternative, as illustrated in FIG. 16, in some embodiments, the structure 10 may include a railroad track 16. In some embodiments, the area between the flowing water body 3 and the drainage area 20 may be a flat, empty area which is devoid of the structure 10. Alternatively, the structure 10 may include trees, rocks, hills, sidewalks and/or other natural and/or manmade or geographical features. Accordingly, as illustrated in FIGS. 1-3, the drain conduit 30 may extend beneath the structure 10 as it traverses the ground 21 from the drainage area 20 to the flowing water body 3.

The flowing water body 3 in the geographical area 2 may include any type of body of water having the flowing water 7. For example and without limitation, in some embodiments, the flowing water body 3 may be a river. Alternatively, the flowing water body 3 may be a drainage canal or aqueduct. In still other embodiments, the flowing water body 3 may include a lake, stream or a stream or flow of water within a river, lake, sea, ocean or other larger body of water.

As illustrated in FIGS. 2 and 3, the flowing water body 3 may have a water body bottom 4. Spaced-apart water body sides 5 may extend or angle upwardly from the water body bottom 4. Water body banks 6 may extend outwardly from the respective water body sides 5. As it traverses the ground 21 from the drainage area 20 to the flowing water body 3, the drain conduit 30 may protrude through one of the water body sides 5, submerged beneath and disposed in fluid communication with the flowing water 7 in the water body 3.

Figure 4:
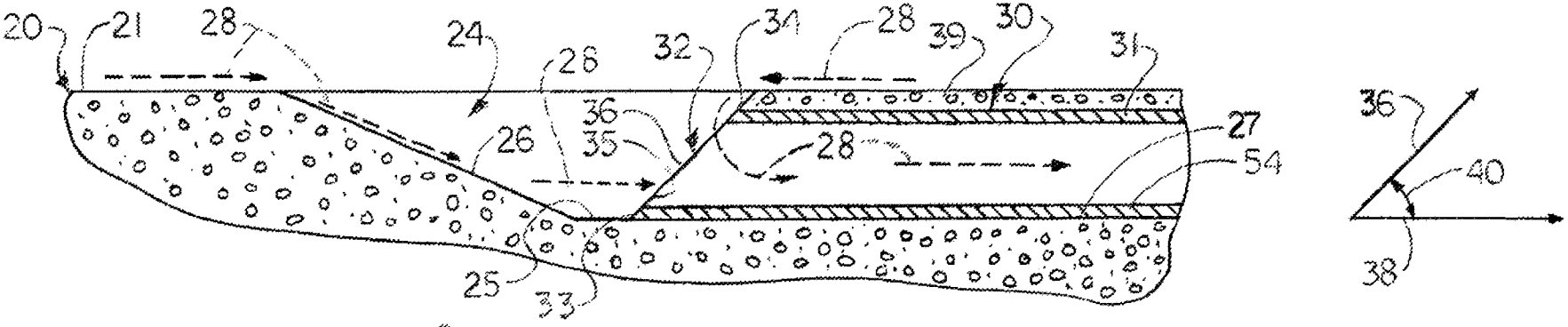
FIG. 4 is an enlarged vertical sectional view, taken along vertical section line 4 in FIG. 2, of a typical drain conduit inlet end of the drain conduit, disposed in fluid communication with the drain inlet opening of the illustrative drainage system.
Figure 5:
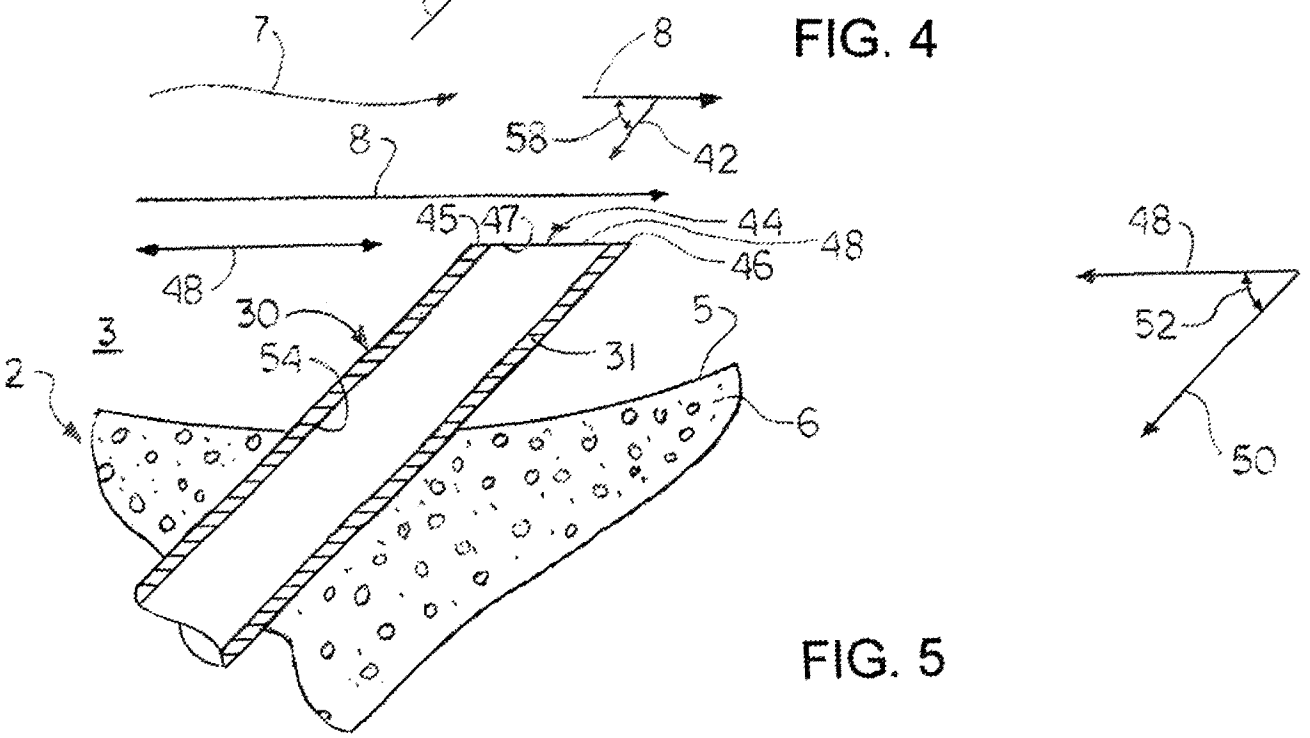
FIG. 5 is an enlarged horizontal sectional view, taken along horizontal section lines 5-5 in FIG. 2, of a typical drain conduit discharge end of the drain conduit, disposed in fluid communication with the water body of the drainage systems.
Figure 6:
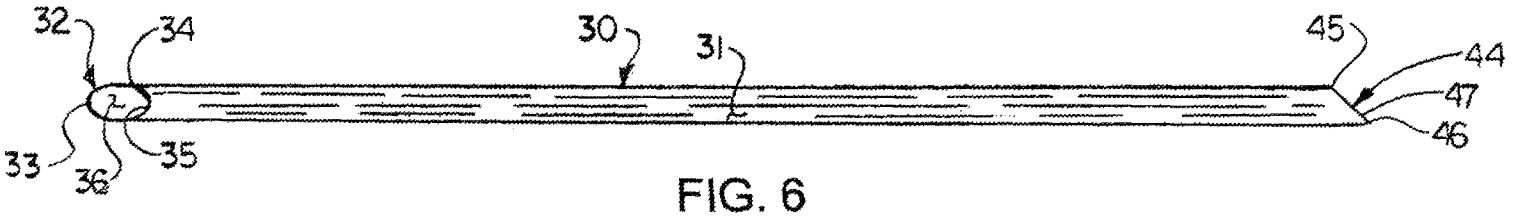
FIG. 6 is a top view of a typical drain conduit suitable for implementation of the drainage systems.
Figure 7:
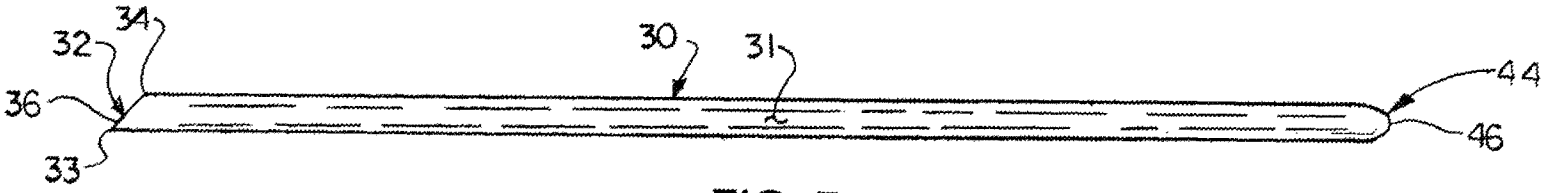
FIG. 7 is a side view of the drain conduit, rotated 90 degrees with respect to the top view orientation illustrated in FIG. 6.
Figure 8:
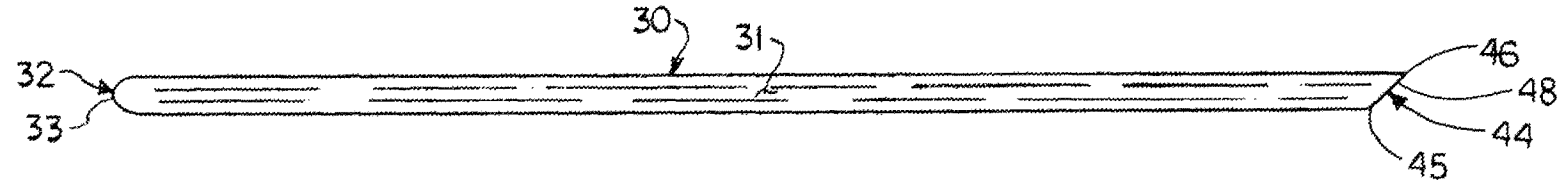
FIG. 8 is a bottom view of the drain conduit, rotated 90 degrees with respect to the side view orientation illustrated in FIG. 7.
Figure 9:
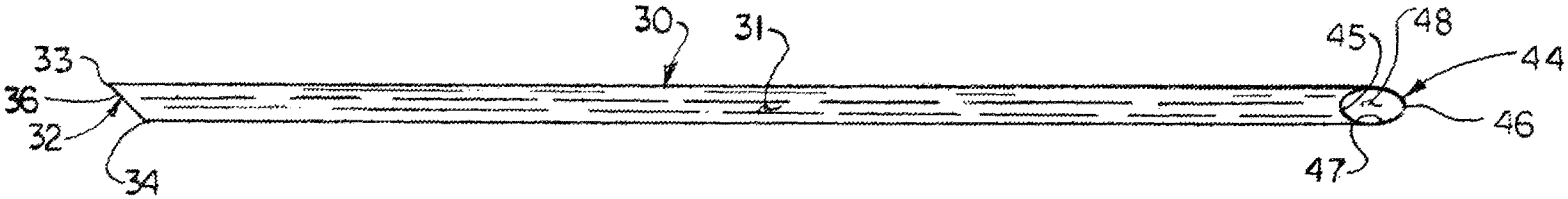
FIG. 9 is a side view of the drain conduit, rotated 90 degrees with respect to the bottom view orientation illustrated in FIG. 8.

As illustrated in FIG. 4, the drain inlet opening 24 may have a drain opening bottom 25. One or more drain opening sides 26 may extend upwardly from the drain opening bottom 25 to the surface of the ground 21 at the drainage area 20. In some embodiments, the drain opening side or sides 26 may slope downwardly from the ground 21 to the drain opening bottom 25. Accordingly, the drain inlet opening 24 may have a funnel shape in cross-section. This configuration of the drain inlet opening 24 may facilitate removal of debris and/or other objects (not illustrated) in the event that the debris or objects fall or are washed into the drain inlet opening 24 under storm conditions, for example. Moreover, the typically sloped surfaces of the drain opening sides 26 may facilitate runoff of the drainage water 28 from the ground 21 into the drain inlet opening 24 and drain conduit 30, respectively.

As illustrated in FIGS. 2-4, a drain conduit bed 27 may extend from the drain inlet opening 24 to the flowing water body 3. The drain conduit 30 may rest on the drain conduit bed 27 as it traverses from the drain inlet opening 24 to the flowing water body 3.

As illustrated in FIGS. 3-9, the drain conduit 30 may have an elongated drain conduit wall 31. The drain conduit wall 31 of the drain conduit 30 may include a drain conduit inlet end 32 having a conduit inlet opening 35. The conduit inlet opening 35 may be disposed in fluid communication with the drain inlet opening 24.

As illustrated in FIG. 3, a conduit bore 54 may be formed by the drain conduit wall 31. The conduit bore 54 may be disposed in fluid communication with the conduit inlet opening 35. The drain conduit wall 31 may have a drain conduit discharge end 44. As illustrated in FIG. 5, the drain conduit discharge end 44 may have a conduit discharge opening 47 disposed in fluid communication with the conduit bore 54. The conduit discharge opening 47 may be submerged beneath and disposed in fluid communication with the flowing water 7 in the flowing water body 3.

In some embodiments, the drain conduit inlet end 32 of the drain conduit 30 may have a truncated, beveled, or tapered profile in cross-section. Accordingly, the drain conduit inlet end 32 of the drain conduit 30 may include a lower edge portion 33 and an upper edge portion 34. The lower edge portion 33 may be disposed at the drain opening bottom 25 of the drain inlet opening 24. The upper edge portion 34 may be disposed at or just beneath the surface of the ground 21 at the drainage area 20. The drain conduit discharge end 44 of the drain conduit 30 may have a truncated, beveled, or tapered profile in cross-section. Accordingly, the drain conduit discharge end 44 of the drain conduit 30 may include an upstream edge portion 45 and a downstream edge portion 46. The downstream edge portion 46 may be downstream with respect to the upstream edge portion 45 along the flowing water direction 8 of the flowing water 7.

Figure 10:
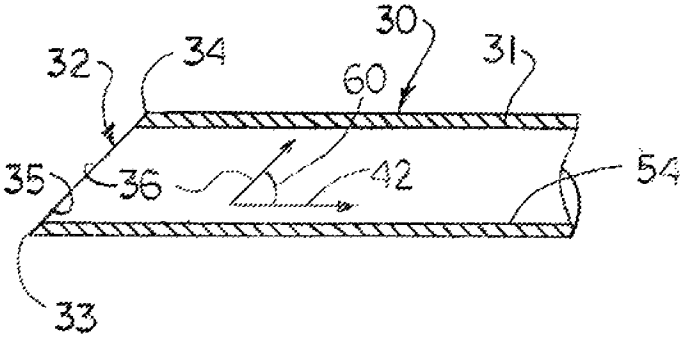
FIG. 10 is an enlarged sectional view of the drain conduit inlet end of the typical drain conduit, with an inlet opening plane of an inlet opening at the drain conduit inlet end oriented at an acute inlet plane angle with respect to a longitudinal drain conduit axis of the drain conduit.

As illustrated in FIG. 4, the conduit inlet opening 35 at the drain conduit inlet end 32 of the drain conduit 30 may be disposed within an inlet opening plane 36. Accordingly, as illustrated in FIG. 10, the inlet opening plane 36 of the conduit inlet opening 35 may be disposed at an acute inlet plane angle 60 with respect to the longitudinal drain conduit axis 42 of the drain conduit 30 at the lower edge portion 33. As illustrated in FIG. 4, the inlet opening plane 36 of the conduit inlet opening 35 may be disposed at an acute inlet end angle 40 with respect to a horizontal plane 38. In some embodiments, the inlet plane angle 60 and the inlet end angle 40 may each be 30-60 degrees, and typically, 45 degrees.

Figure 11:
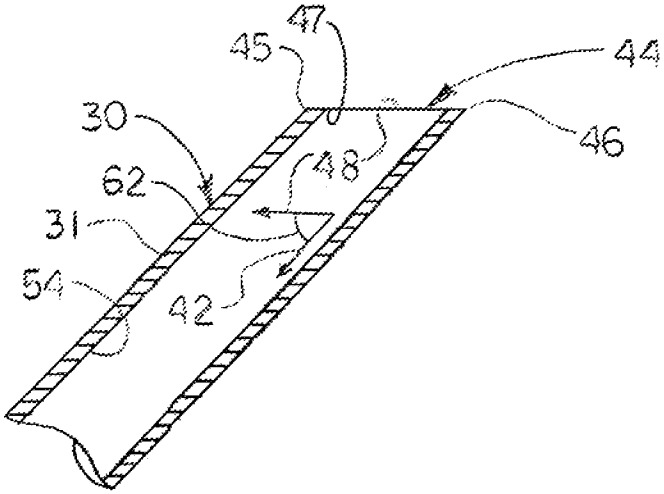
FIG. 11 is an enlarged sectional view of the drain conduit discharge end of the typical drain conduit, with a discharge opening plane of a discharge opening at the drain conduit discharge end oriented at an acute discharge plane angle with respect to the longitudinal drain conduit axis of the drain conduit.

As illustrated in FIG. 5, the conduit discharge opening 47 at the drain conduit discharge end 44 of the drain conduit 30 may be disposed within a discharge opening plane 48. Accordingly, as illustrated in FIG. 11, the discharge opening plane 48 of the conduit discharge opening 47 may be disposed at an acute discharge plane angle 62 with respect to the longitudinal drain conduit axis 42 of the drain conduit 30 at the downstream edge portion 46. As illustrated in FIG. 5, the discharge opening plane 48 of the conduit discharge opening 47 may be disposed at an acute discharge end angle 52 with respect to a vertical plane 50. In some embodiments, each of the discharge plane angle 62 and the discharge end angle 52 may be 30-60 degrees, and typically, 45 degrees.

As further illustrated in FIG. 5, the drain conduit 30 may have a longitudinal drain conduit axis 42. The longitudinal drain conduit axis 42 may be disposed at an acute drain conduit angle 58 with respect to the flowing water direction 8 as measured on an upstream side of the drain conduit 30. The discharge opening plane 48 of the conduit discharge opening 47 may be oriented parallel to the flowing water direction 8 of the flowing water 7 in the flowing water body 3. Accordingly, in typical application of the drainage system 1, which will be hereinafter further described, as the flowing water 7 in the flowing water body 3 adjacently traverses the conduit discharge opening 47, the flowing water 7 may induce negative fluid pressure through the conduit discharge opening 47, the conduit bore 54 and the conduit inlet opening 35 of the drain conduit 30 and the drain inlet opening 24 in the ground 21 at the drainage area 20, respectively. The induced negative fluid pressure may draw the drainage water 28 from the ground 21 at the drainage area 20 through the drain inlet opening 24 and the conduit inlet opening 35, the conduit bore 54 and the conduit discharge opening 47, respectively, of the drain conduit 30 into the flowing water body 3.

Figure 13:
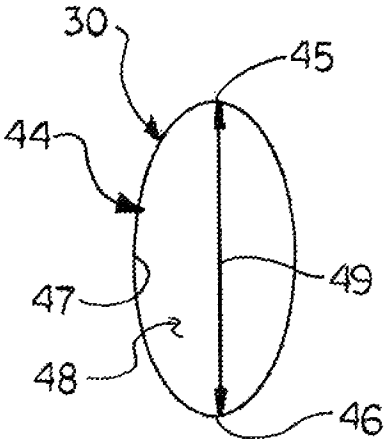
FIG. 13 is a front view of a typical elliptical discharge opening at the drain conduit discharge end of the drain conduit, with the discharge opening having a discharge opening plane with an elongated longitudinal discharge opening axis.
Figure 14:
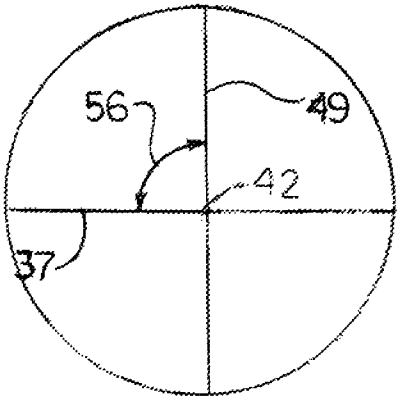
FIG. 14 illustrates the longitudinal discharge opening axis of the conduit discharge opening oriented 90 degrees about the longitudinal drain conduit axis with respect to the longitudinal inlet opening axis of the conduit inlet opening.
Figure 12:
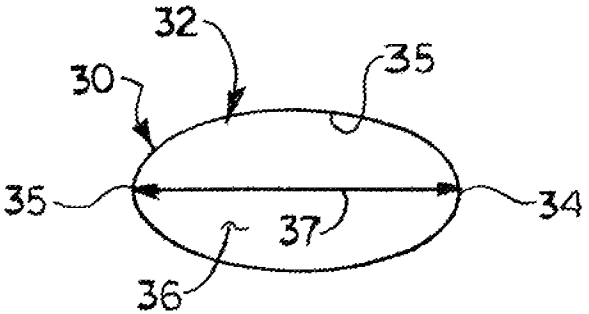
FIG. 12 is a front view of a typical elliptical inlet opening at the drain conduit inlet end of the drain conduit, with the inlet opening having an inlet opening plane with an elongated longitudinal inlet opening axis.

As illustrated in FIG. 12, in some embodiments, the conduit inlet opening 35 at the drain conduit inlet end 32 of the drain conduit 30 may be elliptical with a longitudinal inlet opening axis 37. As illustrated in FIG. 13, the conduit discharge opening 47 at the drain conduit discharge end 44 of the drain conduit 30 may be elliptical with a longitudinal discharge opening axis 49. As illustrated in FIG. 14, the longitudinal discharge opening axis 49 of the conduit discharge opening 47 may be oriented 90 degrees 56 about the longitudinal drain conduit axis 42 with respect to the longitudinal inlet opening axis 37 of the conduit inlet opening 35.

In typical application of the drainage system 1, the drain inlet opening 24 may be formed in the ground 21 at the drainage area 20 and the drain conduit bed 27 formed in the ground 21 from the drainage area 20 to the flowing water body 3. In some applications, this may be accomplished by digging the drain conduit bed 27 using a backhoe or other earth-moving equipment suitable for the purpose. In other applications, this may be accomplished by tunneling the drain conduit bed 27 in the ground 21 typically in the standard or conventional manner. The tunneling method may be used in applications in which the structure 10 is already in place on the ground 21 between the drainage area 20 and the flowing water body 3.

The drain conduit 30 may be deployed in place on the drain conduit bed 27 with the conduit inlet opening 35 at the drain conduit inlet end 32 disposed in communication with the drain inlet opening 24 and the conduit discharge opening 47 at the drain conduit discharge end 44 submerged beneath and disposed in fluid communication with the flowing water 7 in the flowing water body 3. In some embodiments, a layer of soil 39 (FIGS. 2-4) may be placed on the drain conduit 30 to cover the drain conduit 30 typically from the upper edge portion 34 of the drain conduit inlet end 32 to the upstream edge portion 45 of the drain conduit discharge end 44.

Due to the acute drain conduit angle 58 (FIG. 5) of the longitudinal drain conduit axis 42 with respect to the flowing water direction 8 of the flowing water 7 in the flowing water body 3, the flowing water 7 does not enter the conduit discharge opening 47, but rather, adjacently traverses the discharge opening plane 48 from the upstream edge portion 45 to the downstream edge portion 46. As it flows past the conduit discharge opening 47 along and adjacent to the discharge opening plane 48, the flowing water 7 induces negative fluid pressure in the conduit discharge opening 47, the conduit bore 54, and the conduit inlet opening 35 of the drain conduit 30 and the drain inlet opening 24, respectively. As illustrated in FIGS. 1 and 4, the negative fluid pressure draws drainage water 28, typically caused by precipitation and/or flooding, from the ground 21 at the drainage area 20 through the drain inlet opening 24 and the conduit inlet opening 35, the conduit bore 54 and the conduit discharge opening 47, respectively, of the drain conduit 30 into the flowing water body 3.

It will be appreciated by those skilled in the art that the drainage system 1 is effective in removing drainage water 28 which may be caused by precipitation, flooding and/or other causes from the ground 21 at the drainage area 20 and discharging the drainage water 28 into the flowing water body 3. Moreover, as the height and the flow rate of the flowing water 7 in the flowing water body 3 increases, such as may occur in flood conditions, the negative fluid pressure which is induced in the drain inlet opening 24 by the flowing water 7 through the conduit discharge opening 47, the conduit bore 54 and the conduit inlet opening 35 of the drain conduit 30, respectively, correspondingly increases. This may result in drainage of a greater volume of the drainage water 28 from the ground 21 at the drainage area 20 during conditions when removal of the drainage water 28 at a maximal rate is most needed.

Figure 17:
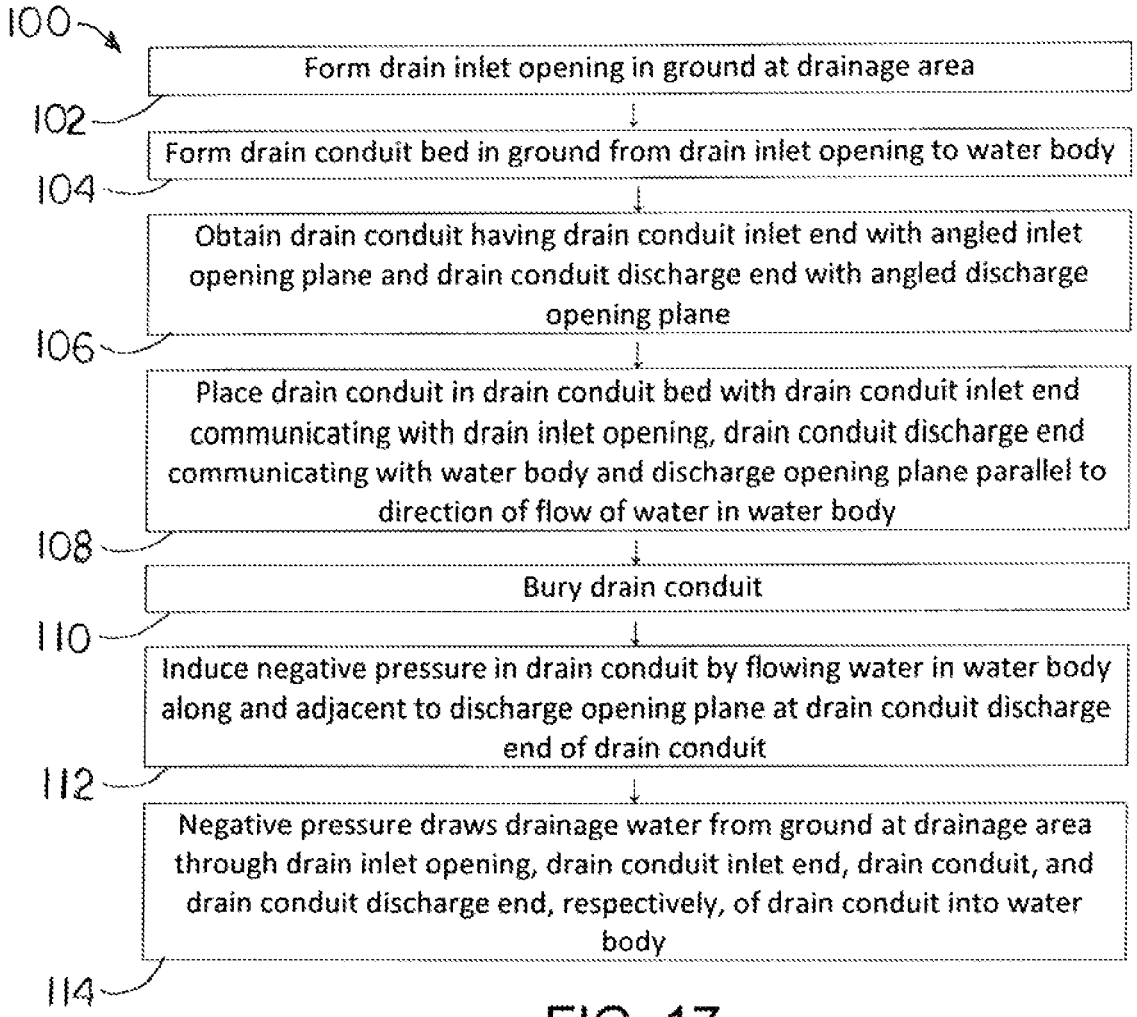
FIG. 17 is a flow diagram of an illustrative embodiment of the drainage methods.

Referring next to FIG. 17 of the drawings, a flow diagram of an illustrative embodiment of the precipitation drainage methods is generally indicated by reference numeral 100. At Step 102, a drain conduit bed may be formed in the ground from a drainage area to a flowing water body.

At Step 104, a drain conduit bed may be formed in the ground from the drain inlet opening to the water body.

At Step 106, a drain conduit may be obtained. The drain conduit may have a drain conduit inlet with an angled inlet opening plane and a drain conduit discharge end having an angled discharge opening plane.

At Step 108, the drain conduit may be placed in the drain conduit bed with the drain conduit inlet end disposed in fluid communication with the drain inlet opening, the drain conduit discharge end disposed in fluid communication with the water body and the discharge opening plane of the drain conduit discharge end parallel to the direction of flow of water in the water body. The drain conduit may have a longitudinal drain conduit axis disposed at an acute drain conduit angle with respect to the flowing water direction as measured on an upstream side of the drain conduit.

At Step 110, the drain conduit may be buried in the drain conduit bed.

At Step 112, negative fluid pressure may be induced in the drain conduit by flowing water in the water body along and adjacent to the discharge opening plane at the drain conduit discharge end of the drain conduit.

At Step 114, the negative fluid pressure may draw the drainage water from the ground at the drainage area through the drain inlet opening, the drain conduit inlet end, the drain conduit and the drain conduit discharge end, respectively, of the drain conduit into the water body.

While the preferred embodiments of the invention have been described above, it will be recognized and understood that various modifications may be made in the invention and the appended claims are intended to cover all such modifications which may fall within the spirit and scope of the invention.

What is claimed is:

1. A drainage system, comprising:

a geographical area including a drainage area from which drainage water is to be drained and a flowing water body having flowing water flowing in a flowing water direction;

a drain inlet opening in the ground at the drainage area;

a drain conduit having a longitudinal drain conduit axis disposed at an acute drain conduit angle with respect to the flowing water direction as measured on an upstream side of the drain conduit, the drain conduit comprising:

a tapered drain conduit inlet end having a conduit inlet opening disposed in fluid communication with the drain inlet opening, the conduit inlet opening of the drain conduit inlet end having a lower edge portion, an upper edge portion and an inlet opening plane disposed at an acute inlet plane angle with respect to the longitudinal drain conduit axis of the drain conduit at the lower edge portion;

a conduit bore disposed in fluid communication with the conduit inlet opening; and a tapered drain conduit discharge end having a conduit discharge opening disposed in fluid communication with the conduit bore, the conduit discharge opening having an upstream edge portion, a downstream edge portion and a discharge opening plane disposed at an acute discharge plane angle with respect to the longitudinal drain conduit axis of the drain conduit at the upstream edge portion and oriented parallel to the flowing water direction of the flowing water in the flowing water body; and whereby as the flowing water in the flowing water body adjacently traverses the conduit discharge opening, the flowing water induces negative fluid pressure through the conduit discharge opening, the conduit bore and the conduit inlet opening of the drain conduit and in the drain inlet opening, respectively, and the negative fluid pressure draws drainage water from the ground at the drainage area through the drain inlet opening and the conduit inlet opening, the conduit bore and the conduit discharge opening, respectively, of the drain conduit into the flowing water body.

2. The drainage system of claim 1 further comprising at least one structure between the flowing water body and the drainage area.

3. The drainage system of claim 2 wherein the at least one structure comprises a levee.

4. The drainage system of claim 2 wherein the at least one structure comprises a road.

5. The drainage system of claim 2 wherein the at least one structure comprises a railroad.

6. The drainage system of claim 1 wherein the flowing water body comprises a river.

7. The drainage system of claim 1 wherein the flowing water body comprises a drainage canal.

8. The drainage system of claim 1 wherein the conduit discharge opening has a longitudinal discharge opening axis oriented 90 degrees about the longitudinal drain conduit axis with respect to a longitudinal inlet opening axis of the conduit inlet opening.

9. A drainage system, comprising:

a geographical area including a drainage area from which drainage water is to be drained and a flowing water body having flowing water flowing in a flowing water direction;

a drain inlet opening in the ground at the drainage area;

a drain conduit having a longitudinal drain conduit axis disposed at an acute drain conduit angle with respect to the flowing water direction as measured on an upstream side of the drain conduit, the drain conduit comprising:

a tapered drain conduit inlet end having an elliptical conduit inlet opening disposed in fluid communication with the drain inlet opening, the conduit inlet opening of the drain conduit inlet end having a lower edge portion, an upper edge portion and an inlet opening plane disposed at an acute inlet plane angle with respect to the longitudinal drain conduit axis of the drain conduit at the lower edge portion;

a conduit bore disposed in fluid communication with the conduit inlet opening;

a tapered drain conduit discharge end having an elliptical conduit discharge opening disposed in fluid communication with the conduit bore, the conduit discharge opening having an upstream edge portion, a downstream edge portion and a discharge opening plane disposed at an acute discharge plane angle with respect to the longitudinal drain conduit axis of the drain conduit at the upstream edge portion and oriented parallel to the flowing water direction of the flowing water in the flowing water body; and whereby as the flowing water in the flowing water body adjacently traverses the conduit discharge opening, the flowing water induces negative fluid pressure through the conduit discharge opening, the conduit bore and the conduit inlet opening of the drain conduit and in the drain inlet opening, respectively, and the negative fluid pressure draws drainage water from the ground at the drainage area through the drain inlet opening and the conduit inlet opening, the conduit bore and the conduit discharge opening, respectively, of the drain conduit into the flowing water body.

10. The drainage system of claim 9 further comprising at least one structure between the flowing water body and the drainage area.

11. The drainage system of claim 10 wherein the at least one structure is a levee, a road or a railroad.

12. The drainage system of claim 9 wherein the conduit discharge opening has a longitudinal discharge opening axis oriented 90 degrees about the longitudinal drain conduit axis with respect to a longitudinal inlet opening axis of the conduit inlet opening.

* * * * *